US008091382B2

(12) United States Patent
Neuman

(10) Patent No.: US 8,091,382 B2
(45) Date of Patent: Jan. 10, 2012

(54) JEWELRY COUPLING AND JEWELRY ARTICLE AND METHOD OF MAKING

(76) Inventor: Joseph M. Neuman, Cleveland Heights, OH (US)

( * ) Notice: Subject to any disclaimer, the term of this patent is extended or adjusted under 35 U.S.C. 154(b) by 616 days.

(21) Appl. No.: 12/113,917

(22) Filed: May 1, 2008

(65) Prior Publication Data

US 2008/0271482 A1 Nov. 6, 2008

Related U.S. Application Data

(60) Provisional application No. 60/915,381, filed on May 1, 2007.

(51) Int. Cl.
*A44C 5/00* (2006.01)

(52) U.S. Cl. ..... 63/3.1; 63/9; 63/10; 63/35

(58) Field of Classification Search ..... 63/1.16, 63/3, 3.1, 4, 7, 9, 18, 19, 23, 10, 35; 403/362, 403/109.6, 306, 378; 24/706.1, 716, 298; 43/43.1, 42.15, 42.16, 42.17, 42.18
See application file for complete search history.

(56) References Cited

U.S. PATENT DOCUMENTS 1,103,422 A * 7/1914 Kluge ..... 63/23
1,200,463 A * 10/1916 Brettner ..... 59/80
4,269,026 A * 5/1981 Bulle et al. ..... 59/82
4,611,368 A * 9/1986 Battersby ..... 24/116 R
5,214,940 A * 6/1993 Capifali ..... 63/21
6,138,356 A * 10/2000 Hertelendy ..... 29/896.41
6,138,475 A * 10/2000 Kohl et al. ..... 63/12
6,718,797 B2 * 4/2004 Plumly ..... 63/18
6,729,159 B2 * 5/2004 Rose ..... 63/29.1
6,804,977 B1 * 10/2004 Grabelle ..... 63/3.1
6,810,685 B2 * 11/2004 Esposito, Jr. ..... 63/39
7,353,665 B2 * 4/2008 Richardson ..... 63/38
7,503,187 B2 * 3/2009 Richardson ..... 63/38
2002/0083737 A1 * 7/2002 Esposito, Jr. ..... 63/3.1

* cited by examiner

*Primary Examiner* — Victor Batson
*Assistant Examiner* — Emily Morgan
(74) *Attorney, Agent, or Firm* — Renner, Otto, Boisselle & Sklar, LLP

(57) ABSTRACT

A jewelry coupling includes a U-shape fitting connectable to respective parts of a necklace to allow two degrees of freedom of motion between the respective parts, e.g., allowing one part to rotate in one plane about one axis and the other part to swivel about another axis. The U-shape fitting includes a pair of spaced-apart disk-like sides with a fastener therebetween and attachable to a jewelry band member allowing rotation thereof about the fastener, a bridge connecting the two disk-like sides and an opening in the bridge for a pin fastener attachable to a decorative jewelry item, e.g., a pendant, allowing for swiveling of the decorative jewelry item about the another axis. A method for assembling an article of jewelry includes attaching a jewelry band member to a jewelry coupling allowing rotation about one axis and attaching a decorative jewelry item to a pin fastener allowing swiveling of the decorative jewelry item relative to the jewelry coupling and Jewelry band member.

18 Claims, 2 Drawing Sheets

JEWELRY COUPLING AND JEWELRY ARTICLE AND METHOD OF MAKING

CROSS-REFERENCE TO RELATED APPLICATION

This application claims the benefit of U.S. Provisional Patent Application Ser. No. 60/915,381, filed May 1, 2007, the entire disclosure of which is hereby incorporated by reference.

TECHNICAL FIELD OF THE INVENTION

The present invention relates generally, as indicated, to jewelry coupling and jewelry article and method of making, and, more particularly, to a coupling approach that provides for two degrees of relative motion between two parts of jewelry, such as, for example, a jewelry band member and a decorative jewelry item.

BACKGROUND

Various types jewelry articles such as, for example, necklaces, bracelets, and the like, may encounter a problem in that they do not always fit in an attractive way when worn by a person. Persons have different body structures, for example, thick or thin necks or wrists, different shape chests, and so forth. In many instances it is desirable for the decorative part of a jewelry article, such as a necklace having a decorative jewelry item suspended from a chain, rope, band, etc. (collectively referred to here and after as jewelry band) or the like to lay flat against the chest of the person so that it does not protrude in an unusual way to cause discomfort to the person and so that it appears in the most attractive way to others viewing the jewelry worn by the person. The same is true for bracelets in which there is a jewelry band member to which a decorative jewelry item is attached.

Some necklaces and bracelets that use a relatively stiff jewelry band member, such as those sometimes referred to as chokers, may have two jewelry band member portions, each attached to a respective end of a decorative jewelry item, e.g., a pendant; and these type articles especially may not conform properly to the different contours of the neck and/or chest of the wearer, e.g., to place the decorative jewelry item in flat engagement against the chest or neck of the wearer and/or to maintain a desired shape, e.g., smooth circular shape, etc. Additionally, stiff necklaces and bracelets may require a large area for storage of the article because the article cannot be folded.

A number of problems have been encountered with necklaces of the type in which the jewelry band member (sometimes simply referred to as the necklace portion or chain of the necklace type article of jewelry) is joined to a pendant by soldering. The pendant portion may not lay snug to the chest of the person wearing the necklace and sometimes will lift up with neck or body movement. Also, the necklace will not always have a continuous round circular appearance when rigidly joined at a connection with a pendant or other decorative jewelry item. When a jewelry band member and a pendant (decorative jewelry item) are solidly connected with solder, for example, a stress point may occur at the joint that may cause the necklace to crack or to break. Further, heavy or delicate jewelry band members (necklaces) need to be stored in a large or bulky container for the necklace to retain its shape and to prevent kinking or breaking of the necklace. Even delicate necklaces that have stiff joints may require bulky boxes for storage to retain the shape of the necklace and to prevent kinking or breaking of the necklace.

SUMMARY

Briefly, the present invention provides for the coupling of two parts of an article of jewelry in a manner that permits two degrees of relative motion or two degrees of relative freedom of motion between the two parts of the article of jewelry. For example, the two degrees of motion may be rotation of one part of the article of jewelry about one axis and the other degree of freedom may permit a swivel type rotation of the other part of the article of jewelry about an axis that extends in a direction that is generally perpendicular to the direction of the first axis. The axes may be or need not be in the same plane and the rotation may be a full 360 degrees of rotation or less than a full 360 degrees of rotation.

As is described in further detail below, one example of a jewelry coupling in accordance with the invention provides for such relative motion between a jewelry band member and a decorative jewelry item. The decorative jewelry item may be a pendant, a brooch, or some other decorative jewelry item.

In another example of the invention, as is described further below, a decorative jewelry item is connected by two jewelry couplings to respective jewelry band members or to the two ends of a single jewelry band member. Further details are described below.

According to an aspect of the invention a jewelry coupling, sometimes referred to herein as "connecting joint," for jewelry includes a U-shape fitting including a pair of side walls in generally parallel, overlapping relation with a space therebetween to receive a jewelry band member or a decorative jewelry item, a bridge between the side walls, the bridge having an opening therein, a first pin between the side walls adapted to extend through an opening in such jewelry band member or decorative jewelry item to hold the same and the U-shape fitting together, the first pin having an axis and such jewelry band member or decorative jewelry item being rotatable about the axis of the first pin, and a second pin extending through and rotatable in the opening in the bridge and adapted to be attached to a jewelry band or decorative jewelry item to provide for swiveling thereof, whereby two degrees of relative motion between such jewelry band member and such decorative jewelry item are provided by the permitted rotation about the first pin axis and the second pin being rotatable in the opening of the bridge to provide swiveling of the jewelry band member or decorative jewelry item attached thereto.

According to another aspect the side walls are generally flat disk-shape and said bridge is attached to both disk-shape side walls at or in proximity to edges of the side walls.

According to another aspect, the first pin is attached to at least one side wall.

According to another aspect, an end of the first pin extends through an opening in one of the side walls.

According to another aspect, the end of the first pin that extends through an opening in one of the side walls is attached to said one of the side walls.

According to another aspect, the first pin is attached to both side walls after one of the jewelry band member or decorative jewelry item is mounted on the first pin.

According to another aspect, the second pin has a head located between the side walls, the head is larger than the opening in the bridge to block pulling of the head through the opening.

According to another aspect, the second pin has a shaft extending through the opening in the bridge, the shaft having an axis, and the second pin being rotatable about the axis of the shaft in the opening in the bridge.

According to another aspect, the first pin and the second pin have respective axes that extend in or approximately in relatively perpendicular directions to provide for such two degrees of relative motion of a jewelry band member and a decorative jewelry item.

According to another aspect, an article of jewelry includes the above connecting joint and further includes a jewelry band member attached to the first pin and a decorative jewelry item attached to the second pin.

According to another aspect, the invention includes a further jewelry band member and a further connecting joint attached to both the further jewelry band member and to the decorative jewelry item, the further connecting joint including a further U-shape fitting including a pair of side walls in generally parallel, overlapping relation with a space therebetween to receive the further jewelry band member or the decorative jewelry item, a bridge between the side walls, the bridge having an opening therein, a first pin between the side walls adapted to extend through an opening in such further jewelry band member or decorative jewelry item to hold the same and the further U-shape fitting together, the first pin having an axis and such further jewelry band member or decorative jewelry item being rotatable about the axis of the first pin, a second pin extending through and rotatable in the opening in the bridge and adapted to be attached to the further jewelry band or decorative jewelry item, and whereby two degrees of relative motion between such further jewelry band member and such decorative jewelry item is provided by the permitted rotation about the first pin axis and the second pin being rotatable in the opening of the bridge to provide swiveling of the jewelry band member or decorative jewelry item attached thereto.

According to another aspect, an article of jewelry includes a jewelry band member, a decorative jewelry item, and a connecting joint including a pair of side members in generally parallel spaced apart overlying relation, a bridge between the side members, a first fastener extending between the side members and connected to one of the jewelry band member or decorative jewelry item holding the jewelry band member or decorative jewelry item to the pair of side members while permitting at least limited rotation thereof in a plane generally parallel to the side members, and a second fastener extending through an opening in the bridge and rotatable about an axis through the opening in the bridge, the second fastener connected to the other of the jewelry band member or decorative jewelry item holding the other of the jewelry band member or decorative jewelry item in rotatable relation to the bridge, whereby the connecting joint provides two degrees of relative rotation of the jewelry band member and decorative jewelry item.

According to another aspect said side members are generally planar disk-shape members, said bridge attaches said disk-shape members together, said bridge has an opening, said second fastener comprises a pin extending through the opening, the pin has a head larger than the opening to prevent withdrawing the head through the opening, an end of the pin being attached to the jewelry band member or decorative jewelry item.

According to another aspect, said first fastener comprising a shaft between the disk-shape members and extending through an opening in the jewelry band member or decorative jewelry item fastened thereto permitting rotation thereof about such shaft.

According to another aspect, the invention includes a further jewelry band member and a further connecting joint similar to the first-mentioned connection joint and connecting the further jewelry band member to the decorative jewelry item.

According to another aspect, the first fastener of each connecting joint is attached to a respective jewelry band member and wherein the second fastener is attached to the decorative jewelry item.

According to another aspect, the decorative jewelry item is soldered to the respective second fasteners.

According to another aspect, the decorative jewelry item is a pendant.

According to another aspect, a method of making an article of jewelry includes attaching a generally U-shape member (also sometimes referred to herein as U-shape fitting) having respective generally parallel overlying sides to an opening in one of a jewelry band member or a decorative jewelry item to permit rotation thereof in space between the generally parallel overlying sides, and attaching the other of the jewelry band member or decorative jewelry item to a pin extending through an opening in a bridge portion of the generally U-shape member that is connected to both of the sides of the U-shape member such that the pin is rotatable in the opening to permit relative rotation of the pin and swiveling of the other of the jewelry band member or decorative jewelry item with respect to the generally U-shape member, thereby to obtain coupling of the jewelry band member and the decorative jewelry item while permitting relative rotation thereof about two different axes.

According to another aspect, said attaching a generally U-shape member includes attaching a pair of generally U-shape members to an end of each of a respective jewelry band member, and said attaching the other comprising attaching a respective pin extending through a respective opening in a respective bridge member to different respective parts of a decorative jewelry item.

These and further aspects and features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the appended claims.

Features that are described and/or illustrated with respect to one embodiment may be used in the same way or in a similar way in one or more other embodiments and/or in combination with or instead of the features of the other embodiments.

It should be emphasized that the term "comprises/comprising" when used in this specification is taken to specify the presence of stated features, integers, steps or components but does not preclude the presence or addition of one or more other features, integers, steps, components or groups thereof.

Many aspects of the invention can be better understood with reference to the following drawings. The components in the drawings are not necessarily to scale, emphasis instead being placed upon clearly illustrating the principles of the present invention. To facilitate illustrating and describing some parts of the invention, corresponding portions of the drawings may be exaggerated in size, e.g., made larger in relation to other parts than in an exemplary device actually made according to the invention. Elements and features depicted in one drawing or embodiment of the invention may be combined with elements and features depicted in one or more additional drawings or embodiments. Moreover, in the drawings, like reference numerals designate corresponding parts throughout the several views and may be used to designate like or similar parts in more than one embodiment.

DESCRIPTION

Figure 1:
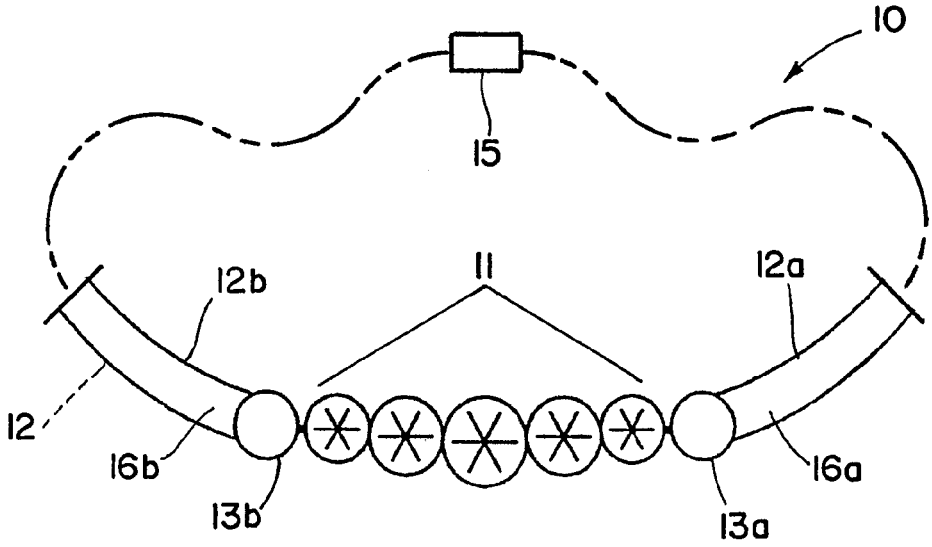
FIG. 1 is a schematic illustration of an article of jewelry employing the present inventions.

Referring to the drawings, wherein like reference numerals designate like parts in the several figures, and wherein it will be appreciated that the illustrations are not necessarily to scale but rather are provided in a manner to illustrate features of the invention, and initially referring to FIG. 1, an article of jewelry 10 is shown. The article of jewelry 10 is illustrated as a necklace; however, it will be appreciated that the article of jewelry may be a bracelet or some other form of jewelry in which a jewelry band member and a decorative jewelry item are coupled together by one or more jewelry couplings. For brevity the article of jewelry 10 will be referred to below as a necklace.

The necklace 10 includes a decorative jewelry item 11, a pair of jewelry band members 12*a*, 12*b* and a pair of jewelry couplings 13*a*, 13*b*. In the illustration of FIG. 1, the decorative jewelry item 11 includes a number of diamonds 14 that are mounted together as a single unit, such as, for example, by a metal holder (not shown). Alternatively, the decorative jewelry item 11 may be some other type of arrangement of diamonds, arrangement of other precious or non-precious stones or jewels, a sculpted or decorative metal, some type of decorative centerpiece, or virtually any other item of jewelry. The decorative jewelry item may be a pendant or a brooch, a metal piece, etc., as still other non-limiting examples.

The jewelry band members 12*a*, 12*b* may be separate band members that are attachable or connectable to each other via a clasp 15 in a conventional manner. Alternatively, the jewelry band members 12*a*, 12*b* may be a single jewelry band member; for example, as a single jewelry band member 12 (designated in the illustration by a dash line), and the two ends 16*a*, 16*b* may be connected, respectively, to the decorative jewelry item 11 by the jewelry couplings 13*a*, 13*b*. As is illustrated in FIG. 1, if the jewelry band member is formed of two parts 12*a*, 12*b* then the respective ends 16*a*, 16*b* thereof may be connected via the jewelry connectors 13*a*, 13*b* to the decorative jewelry item 11 in the manner illustrated, for example, in FIG. 1.

The jewelry band members may be, for example, one or more chains, one or more straps, one or more strings or ropes, one or more cords, etc. An example of a relatively inflexible type of jewelry band member is that known as an omega chain, omega necklace or omega band. A difficulty encountered in the past with omega band type articles of jewelry had been the relatively inflexible attachment of a decorative jewelry item to the ends of the omega band, such as, for example, the ends 16*a*, 16*b* illustrated in FIG. 1. In such case, the omega band may be relatively inflexible and, thus, not fit smoothly or contourly against the body of a person wearing the article of jewelry, and the decorative jewelry item also may not lie flat against the chest area or neck area of the person wearing such article of jewelry.

Figure 2:
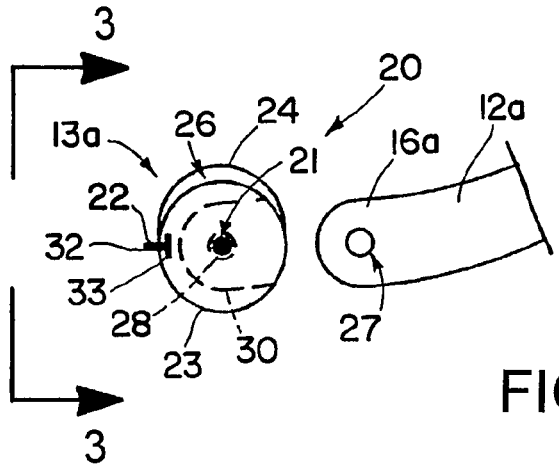
FIG. 2 is an exploded, partially isometric, view of an attachment of a jewelry coupling to a jewelry band member.

Turning to FIG. 2, a jewelry coupling 13*a* is illustrated. The jewelry coupling 13*b* (FIG. 1) may be similar to or the same as the jewelry coupling 13*a*, only one of which is described in detail for brevity. The jewelry coupling 13*a* includes a U-shape fitting 20 and a pair of fasteners 21, 22. The fasteners may be pins, rivets, or other members that provide the features described below. The U-shape fitting 20 includes two sides 23, 24 and a bridge 25. Each of the U-shape fitting 20 sides 23, 24 may be disk-like or of a disk-like shape, e.g., having a generally thin thickness dimension and a relatively larger radius from the center of each disk. The disk-like members may be of circular plan view or they may be of some other shape, e.g., oval, polygonal, triangular, pear, heart, or other shape, etc. The shape of the sides 23, 24 may be determined by aesthetics to provide a pleasing appearance for the article of jewelry. The shape of the sides 23, 24 and their respective size dimensions may be such as to provide a measure of protection for the end 16*a* of jewelry band member 12*a* where the jewelry band member is retained within the space 26 between the respective sides 23, 24.

The fastener 21 of the jewelry coupling 13*a* may be a rivet, a pin, a screw or bolt, etc. The fastener 21 extends between the spaced apart sides 23, 24 of the jewelry coupling. The end 16*a* of the jewelry band member 12*a* has an opening, e.g., a hole 27, through which the fastener 21 extends to attach the U-shape fitting 20 to the jewelry band member 12*a*. For example, to assemble the U-shape fitting 20 to the jewelry band member 12*a*, the end 16*a* is placed between the sides 23, 24 of the U-shape fitting 20 to align the hole 27 with holes 28, 29 in the respective sides 23, 24 of the U-shape fitting. The fastener 21, for example, in the form of a rivet (sometimes referred to herein as a "rivet fastener" for brevity of the description) having a generally circular cross section and a linear extent (linear axis) may be inserted through the openings 27, 28 and 29. The ends of the rivet fastener 21 may be secured to the respective sides 23, 24 by adhesive, solder, screwing, peening the ends of the rivet at the outside surfaces of the sides 23, 24 relative to the interior surfaces of the sides bounding the space 26 in which the end 16*a* of the jewelry band member is located, etc. The jewelry band member 12*a* then can rotate about the axis of the rivet fastener 21.

If the rivet fastener 21 were removable, it may be removed so as to facilitate substituting a different jewelry band member 12*a*, 12*b* or decorative jewelry item 11, thus making a different looking article of jewelry 10.

The bridge 25 and the rivet fastener 21 hold the sides 23, 24 of the U-shape fitting 20 in the illustrated and described in the generally parallel spaced-apart, generally overlying relation. The jewelry band member can rotate a substantial polar distance about the axis of the rivet fastener 21, limited primarily only by the bridge 25 that would interfere with full 360 degree rotation about the axis of the rivet fastener 21. Such rotation may be limited further if desired, by increasing the circumferential extent or length of the bridge 25 from that extent that is illustrated in the drawings. Using the rivet fastener 21 and bridge 25 to hold the sides 23, 24 in relation to each other provides a relatively strong structure and a good securement of the U-shape fitting 20 to the end 16*a* of the jewelry band member 12*a*. Moreover, by providing relatively large area of parallel overlap between the sides 23, 24 and surface of the jewelry band member such space being represented by dash lines 30 in FIG. 2, the jewelry coupling 13*a* is held relatively securely with respect to the end 16*a* with relatively little or at least with controlled wobble.

Figure 3:
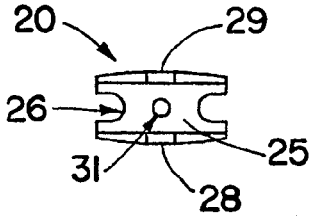
FIG. 3 is an end elevation view of a portion of the jewelry coupling looking in the direction of the arrows 3-3 of FIG. 2.

With reference to FIGS. 2 and 3, the jewelry coupling 13*a* also includes the fastener 22, as was mentioned above. The fastener 22 extends through and opening 31 in the bridge 25 and may be attached or connected to the decorative jewelry item 11 in the manner illustrated in FIGS. 1 and 4, for example. The fastener 22 is in the form of a pin having an elongate shaft 32 and a head 33. For brevity of description the fastener 22 may be referred to as "pin fastener." The shaft extends through the opening 31 in the bridge in the manner illustrated in FIGS. 2 and 5, for example. The head 33 is larger than the size of the opening 31 and, therefore, prevents the pin fastener 22 from being pulled all the way through the opening 31.

Figure 4:
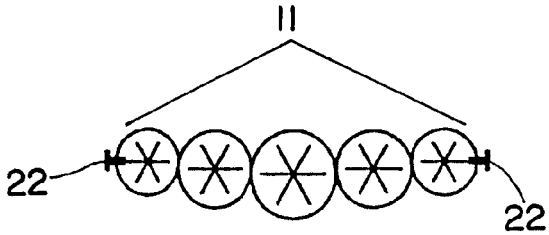
FIG. 4 is a planned view of a decorative jewelry item with pins of respective jewelry couplings illustrated in attachment with the decorative jewelry item.
Figure 5:
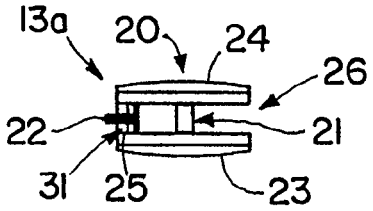
FIG. 5 is a side elevation view of a jewelry coupling.

FIG. 5 illustrates the jewelry coupling 13*a* with the rivet fastener 21 holding the disk—like sides 23, 24 in parallel space type and apart relation, leaving a gap or space 34 therebetween. In FIG. 5 the bridge 25 with the pin fastener 22 in the opening 25 also is shown. The jewelry band member 12*a* and decorative jewelry item 11, which are described above, are not illustrated in FIG. 5 so that a clear view of the jewelry coupling 13*a* can be seen. For example, the manner of connecting the jewelry band member 12*a* to the jewelry coupling 13*a* is illustrated in FIG. 2 and also in FIG. 8, which is described further below; and the manner of attaching the jewelry coupling 13*a* to a decorative jewelry item 11 is illustrated in FIGS. 2 and 4.

Briefly referring back to FIG. 4, the pin fasteners 22, a separate one for each of the jewelry couplings 13*a*, 13*b* are attached to the decorative jewelry item 11. In the illustration of FIG. 4 and also of FIG. 1, the decorative jewelry item is generally linear in shape and the pin fasteners 22 are attached at opposite ends of the decorative jewelry item 11. Such attachment may be by soldering the ends of the shafts 32 of the pin fasteners 22 to the decorative jewelry item. Alternatively, an adhesive material, cement, welding, etc., may be used to effect such attachment. With the pin fasteners 22 attached to the ends of the decorative jewelry item 11, such jewelry item may rotate with the respective pin fasteners 22, as they may rotate about the respective axes thereof in the openings 31 as is described further below.

Figure 6:
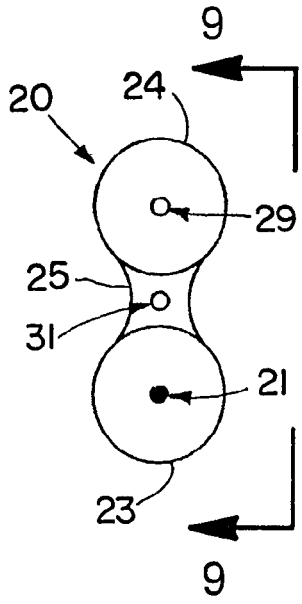
FIG. 6 is an unfolded plan view of the U-shape fitting portion of the jewelry coupling.
Figure 7:
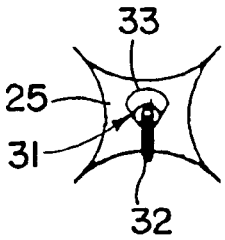
FIG. 7 is a fragmentary view of the bridge between the side walls of the U-shape fitting having a pin extending through an opening through the bridge.

In FIG. 6 the U-shape fitting 20 is illustrated unfolded. The U-shape fitting 20 may be prepared by stamping it in the shape illustrated in FIG. 6. The stamping may be from a metal material, a base metal having a decorative plating or other coating thereon, etc. Examples of such plating or coating material or of the base material may be silver, gold, platinum, alloys of those materials, etc. Various types of materials are known for use in the field of jewelry and may be used as the material for the U-shape fitting. In FIG. 6 the rivet fastener 21 is illustrated protruding upwards from the plane of the paper of the drawing already as an integral part of the U-shape fitting blank 20. The rivet may be secured to the side 23 of the U-shape member 20. Such attachment may be by adhesive material, soldering, welding, etc. The pin fastener 22 is shown in FIG. 7 protruding through the opening 31 in the bridge 25. The illustration of FIG. 7 is somewhat of an isometric nature so that the shaft 32 of the pin fastener 22 can be seen; and the illustration in FIG. 7 is somewhat fragmentary showing only the bridge 25 without showing the sides 23, 24 of the U-shape fitting 20. The pin head 33 prevents the pin fastener 22 from pulling out through the opening 31.

An example manner of making the U-shape fitting 20 and attaching it to a jewelry band member 12*a* and to a decorative jewelry item 11 are exemplified in FIGS. 2, 5, 6, 7 and 8 and also with reference to FIGS. 1 and 4. For example, the blank of which the U-shape fitting 20 is made is prepared in the manner shown in FIG. 6 as a flat piece of metal of the shape illustrated in FIG. 6. The rivet fastener 21 is attached to the side 23 to extend upward out of the plane of the paper of the drawing. A pin fastener 22 is inserted through the opening 31 in the bridge 25 in the manner illustrated in FIG. 7 such that the pin shaft 32 extends away from the sheet material of which the blank 20 is formed in a direction opposite to that in which the rivet fastener 21 extends, as is seen in FIG. 9. Thus, the pin fastener 22 is in place in the U-shape fitting 20 prior to folding the sides about the bridge 25. The upstanding shaft (relative to the illustration in FIG. 6) may be inserted through the hole 27 in the jewelry band member 12*a*, and the sides 23, 24 of the U-shape fitting may be bent or folded toward each other about the bridge 25 to achieve a shape similar to that illustrated in FIGS. 2, 3, 5 and 8. The distal end of the shaft of the rivet fastener 21 may be inserted through the opening 29 in the side 24 and may be secured to the side 24 using adhesive, cement, epoxy, peening, soldering, welding, etc.

Figure 8:
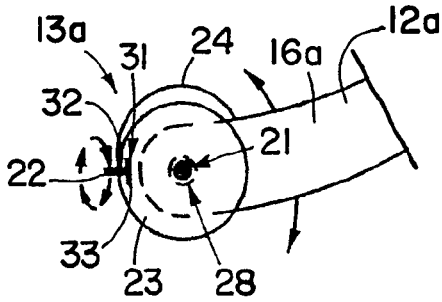
FIG. 8 is a schematic top elevation view illustrating the jewelry coupling attached to one end of a jewelry band member.
Figure 9:
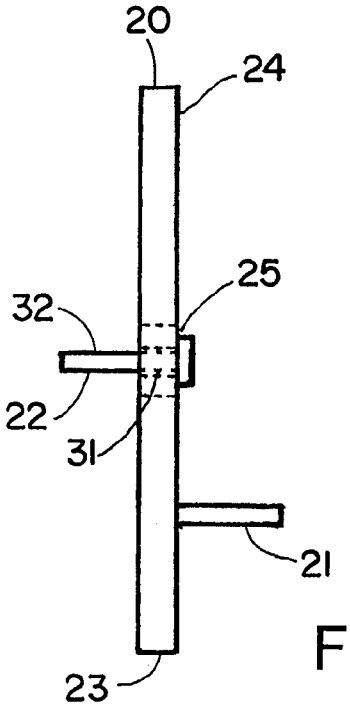
FIG. 9 is a schematic edge elevation view of the U-shape fitting portion of the jewelry coupling looking in the direction of the arrows 9-9 of FIG. 6.

As is shown in FIG. 8, the jewelry coupling 13*a* is assembled completely with the jewelry band member 12*a* and with the shaft 32 of the pin fastener 22 exposed beyond the bridge 25. The exposed shaft 32 may be attached to a decorative jewelry item 11, for example, by soldering, welding, adhesive, epoxy, or some other manner, for example, to achieve attaching thereof to the decorative jewelry item 11 in the manner illustrated, for example, in FIGS. 1 and 4.

As is seen in FIG. 8, the axis of the rivet fastener 21 and the axis of the pin fastener 22 extend generally in perpendicular directions. The jewelry band member may rotate with the pin fastener about the axis of the rivet fastener 21. The decorative jewelry item 11 may rotate about the axis of the shaft 32 of the pin fastener 22. As those axes are generally perpendicular to each other, two degrees of relative movement or two degrees of freedom relative to each other, is provided for the jewelry band member 12*a* and the decorative jewelry item 11; and the motion of one is rotation and of the other is swivel.

If desired, the U-shape fitting 20 may be cast, die struck, or otherwise formed in partially folded relation of the sides 23, 24 relative to each other and/or to the bridge 25 providing adequate space to insert the pin fastener 22 into the hole 31 and to place the hole 27 of the jewelry band member over the rivet fastener 21. The folding or bending then can be completed to form the jewelry coupling 13*a*, for example, as is shown in the drawings attached to the jewelry band member 12*a*.

Further description of the jewelry coupling and methods of making and using it are described below.

In FIG. 1, the article of jewelry 10 may be an omega style necklace having a pair of jewelry band members 12*a*, 12*b* (or a single jewelry band member 12) with a diamond centerpiece as the decorative jewelry item 11. The jewelry couplings 13*a*, 13*b* serve as respective connecting joints between the jewelry band members and the decorative jewelry item. The jewelry couplings 13*a*, 13*b* (connecting joints) allow the jewelry band members to rotate and the decorative jewelry item to swivel.

As is seen in FIG. 2, the pin fastener 22 is shaped having a pin-like elongate shaft 32 and a pinhead 33. The U-shape fitting 20 has round or circular disk-shape sides 23, 24. In the center of the side 23 is the rivet fastener 21. The end 16*a* of the jewelry band member 12*a* is shown exploded away from the U-shape fitting 20, but it will be appreciated that such end is to be placed within the space 26 between the sides 23, 24 of the U-shape fitting 20 and to be retained by the rivet fastener passing through the hole 27 in the jewelry band member. It also will be appreciated that although the shape of the disk-like sides 23, 24 is round or circular, they may be of another shape.

As is seen in FIG. 3, the bridge 25 is attached to the sides 23, 24 at or near (proximate) an edge portion of each of those sides. As is shown in FIG. 6, the bridge 25 and the sides 23, 24 may be integral as a single piece.

As is shown in FIG. 5, the pin fastener is inserted through the opening 31 in the bridge 25, and the rivet fastener 21 is shown between the disk-like sides 23, 24 of the U-shape fitting. The bridge 25 and the rivet fastener 21 may cooperate to maintain the generally parallel relation of the two sides 23, 24 such that they are spaced apart and in generally parallel and generally overlying relation. The head 33 of the pin fastener 22 is larger than the size of the hole 31 in the bridge 25, and the diameter of the shaft 32 of the pin fastener 22 is sufficiently narrower in size/shape than the configuration of the hole 31 so as to allow the shaft 32 to rotate in the opening 31 while the head 33 prevents the pin fastener from pulling out of the hole 31. When the pin fastener 22 is attached, e.g., by soldering or some other means, to a decorative jewelry item 11, the decorative jewelry item 11 and the U-shape fitting can swivel relative to each other in complete circles, e.g., in a full 360 degrees. The rivet fastener 21 passes through the opening 27 of the jewelry band member 12*a*, for example, and, thus, connects the U-shape member and the jewelry band member.

FIG. 6 illustrates the U-shape member in a open flat configuration with the rivet fastener 21 protruding upward out of the plane of the drawing and the opening 31 in the bridge 25 ready to receive inserted therein the shaft 32 of the pin fastener 22. The U-shape member may have been stamped to such shape from a flat blank or having been pried open from a configuration as shown in the U-shape thereof in several drawing figures. When the sides 23, 24 are folded relative to the bridge 25 so that the sides are in parallel overlying relation, e.g., as is illustrated in FIGS. 2, 3 and 5, the distal end of the rivet fastener 21 will fit into the hole 29 of the side 24. The end of the rivet may fit securely in the hole 29 so that it is retained therein by a firm frictional fit. If desired, additional fastening material may be used to retain the end of the rivet in the hole 29, such as, for example, soldering, welding, adhesive, epoxy, etc.

FIG. 7 illustrates the bridge 25 with the shaft 32 of the pin fastener 22 extending through the hole 31 and the head 33 of the pin fastener being stopped by a surface of the bridge 25 preventing the pin fastener from pulling through the opening 31.

As is illustrated in FIG. 8, the rivet fastener 21 has been inserted through the opening 27 in the end 16*a* of the jewelry band member 12*a*. The rivet fastener fits relatively loosely in the hole 27 so that the jewelry band member 12*a* will easily rotate about the rivet fastener 21. When the jewelry coupling 13*a* is fully assembled in the manner described above, the shaft 32 of the pin fastener 22 is soldered or otherwise attached to the decorative jewelry item 11 and the distal end of the rivet fastener 21 may be soldered to the side 24 of the U-shape member in the area of the hole 29.

In the finished product of article of jewelry 10 the jewelry bands 12*a*, 12*b* can smoothly rotate joined to the respective jewelry couplings 13*a*, 13*b*. The decorative jewelry item 11 or the respective jewelry couplings can swivel in complete circles about the axis of the pin fastener 22.

The jewelry band members 12*a*, 12*b* or single jewelry band member 12 may be an omega style jewelry band member or may be another type of jewelry band member, e.g., a chain, rope, cord, etc. Furthermore, the jewelry band member may be or be part of a necklace, a bracelet, a pendant, or some other jewelry item.

The shape of the sides 23, 24 of the U-shape fitting 20 may be other than circle shape; other examples include shapes such as triangle, square, oval, heart, etc.

The U-shape fitting 20 may be one piece or it may be multiple pieces appropriately fastened together to provide the functions described herein.

The decorative jewelry item 11 may be gold and diamonds, e.g., as is illustrated, or it may include various other stones and/or other metals and may be with or without stones or jewels.

As was mentioned above, fastening of parts of the jewelry coupling may be carried out using solder or using some other means of securing.

The present invention may obtain one or more of the following advantages:

The decorative jewelry item will tend to flex to the contour of the chest of a person wearing the article of jewelry 10 since pin fastener 22 and the bridge 25 allow the decorative jewelry item to pivot toward the chest without any significant resistance.

For a round omega style necklace, the rivet fastener 21 and the hole 27 in the jewelry band member 12*a*, for example, allows movement north and south to give the jewelry band member 12*a* and the decorative jewelry item 11 a continuous round circular appearance even with body movement.

Stress on the jewelry band member 12*a*, for example, connected to the jewelry coupling 13*a* is removed due to flexibility allowed by the rivet fastener 21 and the hole 27 in the jewelry band member 12*a* and the pin fastener 22 and the bridge 25, the result being that the jewelry band member 12*a* will tend not to crack or break at or next to the joint with the decorative jewelry item 11.

The U-shape fitting 20 and its components allow the jewelry band members 12*a*, 12*b* to be folded at the jewelry coupling relative to the decorative jewelry item 11. This results in an article of jewelry 10 having a decorative jewelry item 11 with relatively stiff jewelry band members being able to be stored in a rectangular box approximately one third the size of a larger box without fear of kinking or breaking.

The article of jewelry 10 according to the invention is relatively flexible in that the decorative jewelry item can be white gold with a certain design on one side and can be yellow gold with a different design on the other side. This allows the wearer two different options with the decorative jewelry item 11, with the jewelry band members 12*a*, 12*b* or jewelry band member 12 remaining stable and the decorative jewelry item 11 having the ability to be rotated from one side to the other depending on wearer's choice.

Furthermore, if the decorative jewelry item 11 is not flexible, for example an "omega" style necklace, and the two sides thereof are different designs or different color gold, this again can be a reversible necklace, by the decorative jewelry item 11 being uniform or flexible using the jewelry couplings

13*a*, 13*b*. Then with the jewelry couplings 13*a*, 13*b*, the decorative jewelry item 11 can be rotated to be worn with either side showing.

The invention may provide one or more advantages and appearance features, for example, as follows:

The rivet fastener 21 may be of a length to such that the U-shape fitting 20 relatively closely fits near the surface of the jewelry band member 12*a*, while there is enough space and the hole 27 is sufficiently large to provide maneuverability in the north and south directions (relative to the illustration of FIGS. 2 and 8, for example) giving the appearance that the jewelry coupling 13*a* and the jewelry band member 12*a* are one piece.

The hole 31 in the bridge 25 may be sufficiently loose for the pin fastener 22 to rotate. The shaft 23 of the pin fastener may be sufficiently short making a relatively snug connection of the jewelry coupling 13*a* to the decorative jewelry item, e.g., as is shown in FIG. 1. This relatively tight connection does not allow the pin fastener 22 to bend giving the pin fastener 22 good strength characteristics because an even and steady rotation of the pin fastener 22 in the opening 31 provides for less wear and tear for longer use than if a longer pin fastener were used. Also, the just described relatively short or snug fit allows the U-shape fitting 20 and the decorative jewelry item 11 to have the appearance of being one piece.

The rivet fastener 21 and the pin fastener 22 are incorporated in the jewelry coupling 13*a* attached between the jewelry band member 12*a* and the decorative jewelry item 11. When worn as a necklace, the fastening components of the jewelry coupling are all hidden. This arrangement with jewelry couplings 13*a*, 13*b* at the respective ends of the decorative jewelry item provides for maximum flexibility and enhances beauty of the article of jewelry 10.

Another advantage of the invention is the multi-purpose effect of the article of jewelry 10 in that it may be used as different appearing necklaces, e.g., by rotating the decorative jewelry item 11 from exposing one surface to the other.

What is claimed is:

1. A connecting joint for jewelry, comprising a U-shape fitting including a pair of side walls and a bridge between the side walls, the bridge having an opening therein, the side walls are generally parallel, overlapping relation with a space therebetween to receive a jewelry band member or a decorative jewelry item, a first pin fastener between the side walls adapted to extend through an opening in one of a jewelry band member or decorative jewelry item to hold the same and the U-shape fitting together, the first pin fastener having an axis and a jewelry band member or decorative jewelry item being rotatable about the axis of the first pin fastener, and a second pin fastener extending through and rotatable in the opening in the bridge and adapted to be attached to the other of a jewelry band member or decorative jewelry item to provide for swiveling of the second pin fastener and of the other of a jewelry band member or decorative item therewith, whereby two degrees of relative motion between a jewelry band member and a decorative jewelry item are provided by the permitted rotation about the first pin fastener axis and the swiveling with the second pin fastener being rotatable in the opening of the bridge, and wherein the first and second pin fasteners extend along respective generally linear axes and wherein the respective axes are generally perpendicular to each other.

2. The connecting joint of claim 1, wherein the side walls are generally flat disk-shape and said bridge is attached to both disk-shape side walls at or in proximity to the edges of the side walls.

3. The connecting joint of claim 1, wherein the first pin fastener is attached to at least one side wall.

4. The connecting joint of claim 3, wherein an end of the first pin fastener extends through an opening in one of the side walls.

5. The connecting joint of claim 4, wherein the end of the first pin fastener that extends through an opening in one of the side walls is attached to said one of the side walls.

6. The connecting joint of claim 1, wherein the first pin fastener is attached to both side walls after one of the jewelry band member or decorative jewelry item is mounted on the first pin fastener by the first pin fastener extending through an opening in a jewelry band member or decorative jewelry item.

7. The connecting joint of claim 1, wherein the second pin fastener has a head located between the side walls, the head is larger than the opening in the bridge blocking pulling of the head through the opening, and wherein the second pin fastener has a shaft extending through the opening in the bridge, the shaft having an axis, and the second pin fastener being rotatable about the axis of the shaft in the opening in the bridge.

8. An article of jewelry comprising the connecting joint of claim 1 and further comprising a jewelry band member attached to the first pin fastener and a decorative jewelry item attached to the second pin fastener.

9. The article of jewelry of claim 8, further comprising a further jewelry band member and a further connecting joint attached to both the further jewelry band member and to the decorative jewelry item, the further connecting joint comprising a further U-shape fitting including a pair of side walls in generally parallel, overlapping relation with a space therebetween to receive the further jewelry band member or the decorative jewelry item, a bridge between the side walls, the bridge having an opening therein, a first pin fastener between the side walls adapted to extend through an opening in one of such further jewelry band member or decorative jewelry item to hold the same and the further U-shape fitting together, the first pin fastener having an axis and such further jewelry band member or decorative jewelry item being rotatable about the axis of the first pin fastener, a second pin fastener extending through and rotatable in the opening in the bridge and adapted to be attached to the other of such further jewelry band member or decorative jewelry item to provide for swiveling of the second pin fastener and of such further jewelry band member or decorative item therewith, and whereby two degrees of relative motion between such further jewelry band member and such decorative jewelry item is provided by the permitted rotation about the first pin fastener axis and the swiveling with the second pin fastener being rotatable in the opening of the bridge.

10. An article of jewelry, comprising a jewelry band member, a decorative jewelry item, and a connecting joint including a pair of side members in generally parallel spaced apart overlying relation, a bridge between the side members, a first pin fastener extending between the side members and connected to one of the jewelry band member or decorative jewelry item holding the jewelry band member or decorative jewelry item to the pair of side members while permitting at least limited rotation thereof in a plane generally parallel to the side members, and a second pin fastener extending through an opening in the bridge and rotatable about an axis through the opening in the bridge, the second pin fastener connected to the other of the jewelry band member or decorative jewelry item holding the other of the jewelry band member or decorative jewelry item in rotatable relation to the bridge, whereby the connecting joint provides two degrees of relative rotation of the jewelry band member and decorative jewelry item.

11. The article of jewelry of claim 10, wherein said side members are generally planar disk-shape members, said bridge attaches said disk-shape members together, said bridge has an opening, said second pin fastener comprises a pin fastener extending through the opening, the pin fastener has a head larger than the opening to prevent withdrawing the head through the opening, an end of the pin fastener being attached to the jewelry band member or decorative jewelry item.

12. The article of jewelry of claim 11, said first pin fastener comprising a shaft between the disk-shape members and extending through an opening in the jewelry band member or decorative jewelry item fastened thereto permitting rotation thereof about such shaft.

13. The article of jewelry of claim 12, comprising a further jewelry band member and a further connecting joint similar to the first-mentioned connecting joint and connecting the further jewelry band member to the decorative jewelry item.

14. The article of jewelry of claim 13, wherein the first pin fastener of each connecting joint is attached to a respective jewelry band member and wherein the second pin fastener is attached to the decorative jewelry item.

15. The article of jewelry of claim 14, wherein the decorative jewelry item is soldered to the respective second pin fasteners.

16. The article of jewelry of claim 11, wherein the decorative jewelry item is a pendant.

17. A method of making an article of jewelry, comprising attaching a generally U-shape member having respective generally parallel overlying sides to an opening in one of a jewelry band member or a decorative jewelry item to permit rotation thereof about a first axis in space between the generally parallel overlying sides in a plane at least approximately generally parallel to the overlying sides, and attaching the other of the jewelry band member or decorative jewelry item to a pin fastener extending along a second axis that is approximately generally perpendicular to the first axis through an opening in a bridge portion of the generally U-shape member that is connected to both of the sides of the U-shape member such that the pin fastener is rotatable in the opening to permit relative rotation of the pin fastener and other of the jewelry band member or decorative jewelry item with respect to the generally U-shape member, thereby to obtain coupling of the jewelry band member and the decorative jewelry item while permitting relative rotation thereof about two different axes.

18. The method of claim 17, said attaching a generally U-shape member comprising attaching a pair of generally U-shape members an end of each of a respective jewelry band member, and said attaching the other comprising attaching a respective pin fastener extending through a respective opening in a respective bridge member to different respective parts of a decorative jewelry item.

* * * * *